US006958665B2

(12) United States Patent
Allison et al.

(10) Patent No.: US 6,958,665 B2
(45) **Date of Patent: *Oct. 25, 2005**

(54) MICRO ELECTRO-MECHANICAL SYSTEM (MEMS) PHASE SHIFTER

(75) Inventors: Robert C. Allison, Rancho Palos Verdes, CA (US); Brian M. Pierce, Moreno Valley, CA (US)

(73) Assignee: Raytheon Company, Waltham, MA (US)

( * ) Notice: Subject to any disclaimer, the term of this patent is extended or adjusted under 35 U.S.C. 154(b) by 147 days.

This patent is subject to a terminal disclaimer.

(21) Appl. No.: 10/405,740

(22) Filed: Apr. 2, 2003

(65) Prior Publication Data

US 2005/0040874 A1 Feb. 24, 2005

(51) Int. Cl.[7] ..... H01Q 3/38; H01P 1/18
(52) U.S. Cl. ..... 333/164; 342/371; 342/375
(58) Field of Search ..... 333/164, 156, 333/32, 262, 109, 55; 342/371, 375

(56) References Cited

U.S. PATENT DOCUMENTS

| | | | | | |
|---|---|---|---|---|---|
| 4,638,269 | A | * | 1/1987 | Dawson et al. | 333/164 |
| 4,859,972 | A | * | 8/1989 | Franke et al. | 333/164 |
| 5,119,050 | A | * | 6/1992 | Upshur et al. | 333/164 |
| 5,379,007 | A | * | 1/1995 | Nakahara | 333/156 |
| 5,578,976 | A | | 11/1996 | Yao | 333/262 |
| 5,880,921 | A | * | 3/1999 | Tham et al. | 361/233 |
| 6,020,795 | A | * | 2/2000 | Kim | 333/33 |
| 6,046,659 | A | | 4/2000 | Loo et al. | 333/262 |
| 6,232,841 | B1 | * | 5/2001 | Bartlett et al. | 330/305 |
| 6,281,838 | B1 | | 8/2001 | Hong | 362/371 |
| 6,331,257 | B1 | | 12/2001 | Loo et al. | 216/13 |
| 6,556,814 | B1 | * | 4/2003 | Klomsdorf et al. | 455/121 |
| 6,600,294 | B1 | * | 7/2003 | DiPiazza | 323/212 |
| 6,670,864 | B2 | * | 12/2003 | Hyvonen et al. | 333/32 |
| 6,741,207 | B1 | * | 5/2004 | Allison et al. | 342/371 |

OTHER PUBLICATIONS

Application Note: Creating Microstrip Footprints.
"Analysis and Development of Microstrip Interdigitated Structures Using FDTD and Statistical Techniques," A Thesis in Electrical Engineering by Jose G. Colom, Aug. 1998.

* cited by examiner

*Primary Examiner*—Dinh T. Le
(74) *Attorney, Agent, or Firm*—Leonard A. Alkov; Karl A. Vick

(57) ABSTRACT

A micro electro-mechanical system (MEMS) phase shifter for shifting the phase of a radio frequency (RF) signal. The phase shifter includes a quadrature coupler having an input port, an output port, a first load port and a second load port. A first variable reactance is coupled to the first load port and a second variable reactance is coupled the second load port. Each variable reactance has a plurality of reflecting phase shifting elements each having an associated micro electro-mechanical system (MEMS) switching element to individually and selectively couple the reflecting phase shifting element to the appropriate load port.

23 Claims, 3 Drawing Sheets

MICRO ELECTRO-MECHANICAL SYSTEM (MEMS) PHASE SHIFTER

TECHNICAL FIELD

The present invention generally relates to phase shifters used in conjunction with antennas and, more particularly, to a MEMS phase shifter for use in coupling a radio frequency (RF) signal to an antenna or in coupling an RF signal received by an antenna to an associated circuit.

BACKGROUND

A wide variety of antennas are used to transmit and/or receive signals at microwave or millimeterwave frequencies. These signals (commonly referred to as radio frequency (RF) signals) often pass through phase shifters between a transceiver circuit and the radiating elements of the antenna. In some applications, a phase shifter is employed to assist in steering an output of the radiating element of a phased array radar assembly. However, phase shifters are also employed in other types of radars and communication devices.

A common type of phase shifter is comprised of a switched path circuit having a number of serially connected stages, each of which form a 50 ohm system. Each stage includes two phase delay lines of different length. For each stage, the RF signal is passed through a selected one of the phase delays by using switches to select a desired path from an input of the switched path circuit to an output of the switched path circuit. Typically, each stage has one delay line dedicated to zero phase shift and the other to a predetermined desired amount of delay. Each stage includes a switching mechanism for connecting an input of the stage to a desired one of the phase delay lines. Another switching mechanism (or recombining switch) functions to connect the selected delay line to an output of the stage. U.S. Pat. No. 6,281,838 includes an example of the foregoing switched path circuit as well as a base-3 embodiment (having three phase delays per stage) of a switched path circuit.

The Applicants have found that switched path phase shifters using MEMS contact switches have limited power handling capability. More specifically, as the RF current associated with the signal increases, the amount of power dissipation within the switches of the switched path phase shifter increases leading to physical failure of the switch devices. The primary failure mechanism has been determined to be power dissipation in the switch contacts.

Accordingly, there exists a need in the art for higher performance phase shifters for use in RF applications and especially in RF applications having relatively high power levels.

SUMMARY OF THE INVENTION

According to one aspect of the invention, the invention is directed to a micro electro-mechanical system (MEMS) phase shifter for shifting the phase of a radio frequency (RF) signal. The phase shifter includes a quadrature coupler having an input port, an output port, a first load port and a second load port; a first variable reactance having a first plurality of reflecting phase shifting elements each having an associated micro electromechanical system (MEMS) switching element to individually and selectively couple the reflecting phase shifting elements of the first variable reactance to the first load port; and a second variable reactance having a second plurality of reflecting phase shifting elements each having an associated MEMS switching element to individually and selectively couple the reflecting phase shifting elements of the second variable reactance to the second load port.

According to another aspect of the invention, the invention is directed to a MEMS phase shifter for shifting the phase of a radio frequency (RF) signal. The phase shifter includes a first and a second phase shifter stage each having a quadrature coupler having an input port, an output port, a first load port and a second load port; a first variable reactance having a first plurality of reflecting phase shifting elements each having an associated micro electromechanical system (MEMS) switching element to individually and selectively couple the reflecting phase shifting elements of the first variable reactance to the first load port; and a second variable reactance having a second plurality of reflecting phase shifting elements each having an associated MEMS switching element to individually and selectively couple the reflecting phase shifting elements of the second variable reactance to the second load port; and wherein the output port of the first phase shifter stage is coupled to the input port of the second phase shifter stage.

BRIEF DESCRIPTION OF DRAWINGS

These and further features of the present invention will be apparent with reference to the following description and drawings, wherein.

DISCLOSURE OF INVENTION

Figure 1:
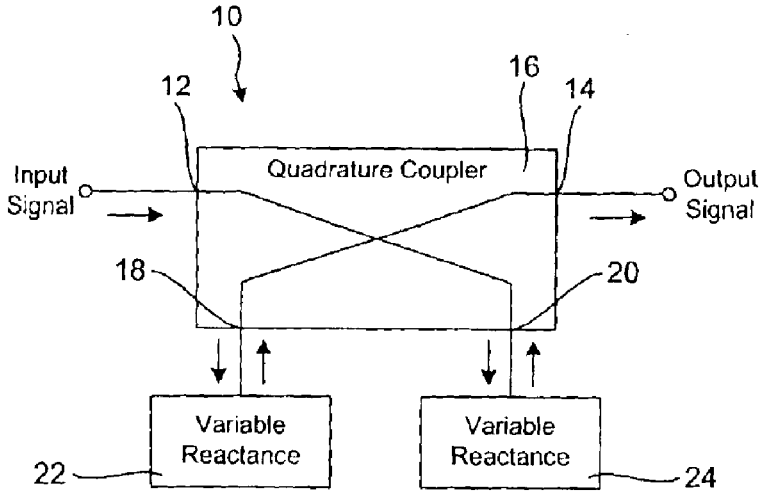
FIG. 1 is a block diagram of a micro electro-mechanical system (MEMS) phase shifter according to the present invention.

In the detailed description that follows, similar components have been given the same reference numerals, regardless of whether they are shown in different embodiments of the present invention. To illustrate the present invention in a clear and concise manner, the drawings may not necessarily be to scale and certain features may be shown in somewhat schematic form.

Referring initially to FIG. 1, shown is a block diagram of a wideband, low loss, micro electro-mechanical system (MEMS) phase shifter 10. In an exemplary embodiment, the MEMS phase shifter 10 is configured to operate reliably at relatively high RF power levels, such as up to about 15 watts and at an operating frequency of about 10 GHz. However, the power handling requirements and bandwidth can vary significantly depending on the phase shifter 10 design and the application in which the phase shifter 10 is used.

The phase shifter 10 can be implemented as a monolithic circuit. For example, as described in greater detail below, the phase shifter 10 can be implemented as an interconnected circuit of microstrip lines and MEMS switching elements that are formed on a single substrate. In one embodiment, the microstrip lines are formed from a metal (e.g., gold, copper, or other conductive material) that is printed on the substrate.

The MEMS phase shifter 10 can be used in a variety of RF circuits, including circuits such as radar and communication devices. In one application, the phase shifter is used as part of an electrically scanned array (ESA). For example, a plurality of phase shifters 10 can be used to couple a transceiver circuit to each radiating element of a phased array radar assembly. As another example, the phase shifter 10 can be used as part of a vehicle (e.g., an automobile or other land based vehicle, an aircraft or a marine vessel) radar system configured to alert a local or remote driver to the presence of a nearby object or to assist in software controlled navigation of the vehicle.

The phase shifter uses a combination of circuit features to increase the phase shifter's power handling capability by minimizing RF current in the contacts of MEMS switching units that are used to selectively establish a desired phase shift. More specifically, RF signal power is split before being applied to the MEMS switching units. In addition, reflecting phase shifting elements comprised of high impedance (e.g., greater than 50 ohms) inductive loads and/or capacitive loads are connected to the MEMS switching units to reduce the current traversing the switches.

The phase shifter 10 has a signal input 12 (also referred to herein as an input port) for receiving an RF signal from a transmitter circuit (not shown), also referred to herein as an input signal. The phase shifter 10 has a signal output 14 (also referred to herein as an output port) for outputting a phased shifted version of the RF input signal, also referred to herein as an output signal. The signal output 14 can be coupled to a radiating element of a radar or a communications device. The phase shifter 10 can be operated in reverse such that an RF signal applied to the signal output 14 can be phase shifted and output at the signal input 12. For example, the phase shifter 10 can also be used as part of a receive path for a radar or communications device where the received RF signal traverses the phase shifter 10 from signal output 14 to signal input 12 during which a shift in phase is introduced. Therefore, the terms signal input and signal output can be used interchangeably.

As will be described in greater detail below, the phase shifter 10 can be implemented with a desired resolution so as to shift the phase of the RF input signal from zero to 360 degrees (or other angle) in selected increments, such as sixteen increments of 22.5 degrees each. For exemplary purposes, the phase shifter 10 described herein operates in X-band. However, the techniques employed by the phase shifter 10 can be applied to other frequencies and can be used to achieve alternative amounts of phase resolution.

As illustrated, the signal input 12 can be an input port of a quadrature coupler 16 and the signal output 14 can be an output port of the quadrature coupler 16. The quadrature coupler 16 splits the RF input signal received at the signal input 12. A first portion of the RF input signal (e.g., half of the RF input signal received at the signal input 12) is coupled to a first port 18 and a second portion of the RF input signal (e.g., the other half of the RF input signal received at the signal input 12) is coupled to a second port 20. The first port 18 and the second port 20 are also referred to herein respectively as a first load port and a second load port. As is common in the art for quadrature couplers, the signal input 12, the signal output 14, the first port 18 and the second port 20 can also be referred to as legs of the quadrature coupler 16.

The first port 18 is coupled to a first variable reactance 22 such that the first portion of the RF input signal is applied to the first variable reactance 22. Similarly, the second port 20 is coupled to a second variable reactance 24 such that the second portion of the RF input signal is applied to the second variable reactance 22. The variable reactances 22, 24 are configured to introduce a desired phase shift on the RF signal. As will be described in greater detail below with reference to FIG. 2, the variable reactances can be implemented with reflective loads selectively coupled to the respective ports 18, 20 by MEMS switching elements.

The first variable reactance 22 phase shifts and reflects the first portion of the RF input signal such that the phase shifted first portion of the RF input signal is returned to the first port 18. The second variable reactance 24 phase shifts and reflects the second portion of the RF input signal such that the phase shifted second portion of the RF input signal is returned to the second port 20. The quadrature coupler 16 recombines the phase shifted first portion of the RF input signal and the phase shifted second portion of the RF input signal to produce the phase shifted RF output signal applied to the signal output 14. Each variable reactance 22, 24 should be selected, to have the same complex load and/or introduce the same amount of phase shift to balance the operation of the quadrature coupler 16. It is also noted that the signal portions incident on the ports 18, 20 can be out of phase by 90 degrees. This phase difference does not affect the total phase shift of the phase shifter 10, but does assist in outputting the phase shifted RF output signal at the signal output 14 rather than returning the signal to the signal input 12.

The quadrature coupler 16 can be implemented as a Lange coupler using microstrip lines. However, Lange couplers can be fabricated to have a wide bandwidth and in a relatively compact space. In addition, the use of a Lange coupler to implement the quadrature coupler 16 can assist in the power handling capability of the phase shifter 10. A description of a suitable 3 dB Lange coupler constructed using microstrip lines and having four 50 ohm ports is presented in Jose G. Colom, "Analysis and Development of Microstrip Interdigitated Structures Using FDTD and Statistical Techniques" (Doctoral Thesis, Pennsylvania State University, 1998), the disclosure of which is herein incorporated by reference in its entirety. In an alternative arrangement, the quadrature coupler can be implemented with a microstrip branch line coupler.

Figure 2:
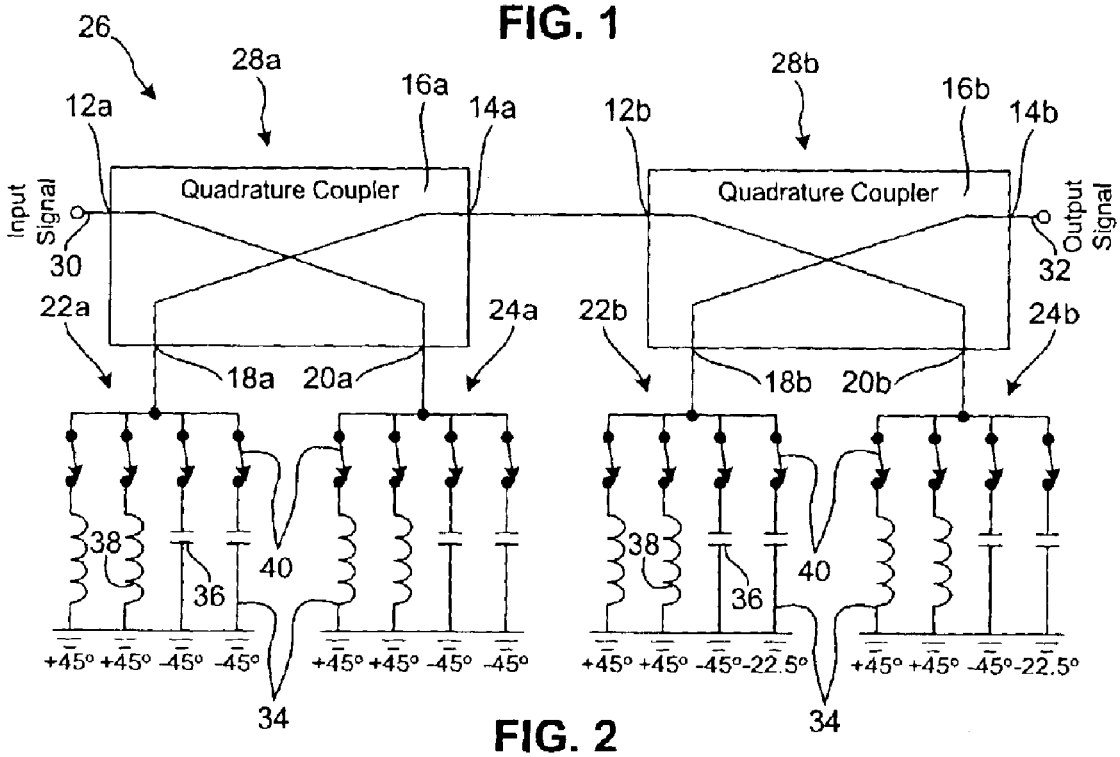
FIG. 2 is a schematic block diagram of an exemplary four bit MEMS phase shifter according to the present invention.

With additional reference to FIG. 2, a schematic block diagram of an exemplary four bit MEMS phase shifter 26 is illustrated. The four bit phase shifter 26 includes two stages 28 arranged in series. Each stage 28 can be implemented using the phase shifter 10 described in connection with FIG. 1. For example, a signal output 14*a* of a first phase shifter stage 28*a* can be coupled to a signal input 12*b* of a second phase shifter stage 28*b*. The signal input 12*a* of the first phase shifter stage 28*a* serves as a signal input 30 for the overall phase shifter 26 and the signal output 14*b* of the second phase shifter stage 26*b* serves as a signal output 32 for the overall phase shifter 26. Similar to the phase shifter 10, the phase shifter 26 can shift the phase of an RF signal traversing the phase shifter 26 from signal input 30 to signal output 32 or traversing the phase shifter 26 from signal output 32 to signal input 30.

FIG. 2 also illustrates each variable reactance 22, 24 in electrical schematic form. More specifically, variable reactances 22*a* and 24*a* are associated with the first stage 28*a* and variable reactances 22*b* and 24*b* are associated with the second stage 28*b*. Each variable reactance 22, 24 can be implemented using one or more reflecting phase shifting elements 34, also referred to herein as loads. For example, each phase shifting element 34 can be made from a transmission line stub. The phase shifting elements 34 are illustrated schematically as capacitive loads 36 and inductive loads 38. The capacitive loads 36 can be used for invoking a negative phase shift and the inductive loads 38 can be used for invoking a positive phase shift.

Each phase shifting element 34 is selectively coupled to a respective quadrature coupler 16 port 18*a*, 18*b*, 20*a* and 20*b* with an associated MEMS switching element 40. Each switching element 40 can be independently controlled by a suitably arranged microprocessor (not shown), control system and/or set of control signals. Each switching unit 40 can be selectively placed in a closed position that couples the associated phase shifting element 34 to the appropriate port 18, 20 or placed in an open position that decouples (e.g., isolates) the associated phase shifting element 34 from the port 18, 20. One or more switching elements 40 for each variable reactance 22, 24 can be simultaneously placed in a closed position to select a desired amount of phase shift. If two or more switching elements 40 are closed, the phase shift developed by the associated phase shifting elements 34 is aggregated (e.g., summed together). If no switching elements 40 are closed for a given variable reactance 22, 24, the RF signal will not be shifted in phase by that variable reactance 22, 24 (e.g., a phase shift of zero degrees is introduced). Similar to the phase shifter 10, each variable reactance 22, 24 for each stage 28 should be configured to have the same complex load and/or introduce the same amount of phase shift to balance the operation of the quadrature coupler 16.

The phase shifter 26 shown by example in FIG. 2 represents a four bit phase shifter capable of shifting an RF input signal from zero degrees to 360 degrees in increments of 22.5 degrees. That is, there are sixteen possible phase angles that can be generated by the phase shifter 26. Noting that a digital four bit word has sixteen possible values, the phase shifter 26 can be controlled using switching element control signals derived from a four bit digital word. More specifically, the desired phase angle is selected by actuating selected switching elements 40 from the open position to the closed position to couple the desired phase shifting elements 34 to the quadrature couplers 16*a* and 16*b*.

A first phase shift can be introduced by the first phase shifter stage 28*a* and a second phase shift can be introduced by the second phase shifter stage 28*b*. The phase shifts of each stage 28 can be aggregated (e.g., summed together) for a total phase shift of the phase shifter 26.

In the illustrated embodiment, the variable reactances 22*a*, 24*a* of the first stage 28*a* each include a pair of plus 45 degree inductive loads 36 and a pair of minus 45 degree capacitive loads 34. The variable reactances 22*b*, 24*b* of the second stage 28*b* each include a pair of plus 45 degree inductive loads 36, a minus 45 degree capacitive load 34 and a minus 22.5 degree capacitive load 34.

In the illustrated example of FIG. 2, the first stage 28*a* is used to implement a "180 degree bit" by being selectively configured to introduce a phase shift of plus or minus 90 degrees, or zero degrees. Zero degrees can be introduced by opening each switching element 40 of the variable reactances 22*a*, 24*a*. A phase shift of plus 90 degrees can be introduced by selecting both pairs of plus 45 degree inductive loads 36 (e.g., by closing the corresponding switching elements 40). A phase shift of minus 90 degrees can be introduced by selecting both pairs of minus 45 degree capacitive loads 34.

In the illustrated example of FIG. 2, the second stage 28*b* is used to add or subtract phase shift to the phase shift of the first stage 28*a* in plus or minus 22.5 degree increments, in plus or minus 45 degree increments, in a plus 90 degree increment, or in a zero degree increment. Therefore, the second stage 28*b* can also be referred to as implementing "90, 45 and 22.5 degree bits." The switching elements 40 of the variable reactances 22*b* and 22*b* are selectively opened or closed to couple desired phase shifting elements 34 to the ports 18*b*, 20*b*. As an example, an overall phase shift of 112.5 degrees can be achieved by selecting each plus 45 degree load for each variable reactance 22*a* and 24*a* of the first stage 28*a* (introduces a phase shift of plus 90 degrees) and selecting a plus 45 degree load and the minus 22.5 degree load for each variable reactance 22*b* and 24*b* of the second stage 28*b* (introduces an addition phase shift of plus 22.5 degrees).

One will appreciate that the phase shifter 26 can be constructed with more than two stages 28, with other combinations of loads and/or with other phase shift amounts per load. In addition, the phase shifter 26 need not be implemented in a four bit arrangement, but can include any desired number of switching unit 40 and phase shifter element 34 assemblies. As a result, the phase resolution (number of degrees per switchable increment) can be modified for the specific RF system of interest and/or a digital word length used by a controller (e.g., three bit, four bit, five bit, and so forth).

Figure 3:
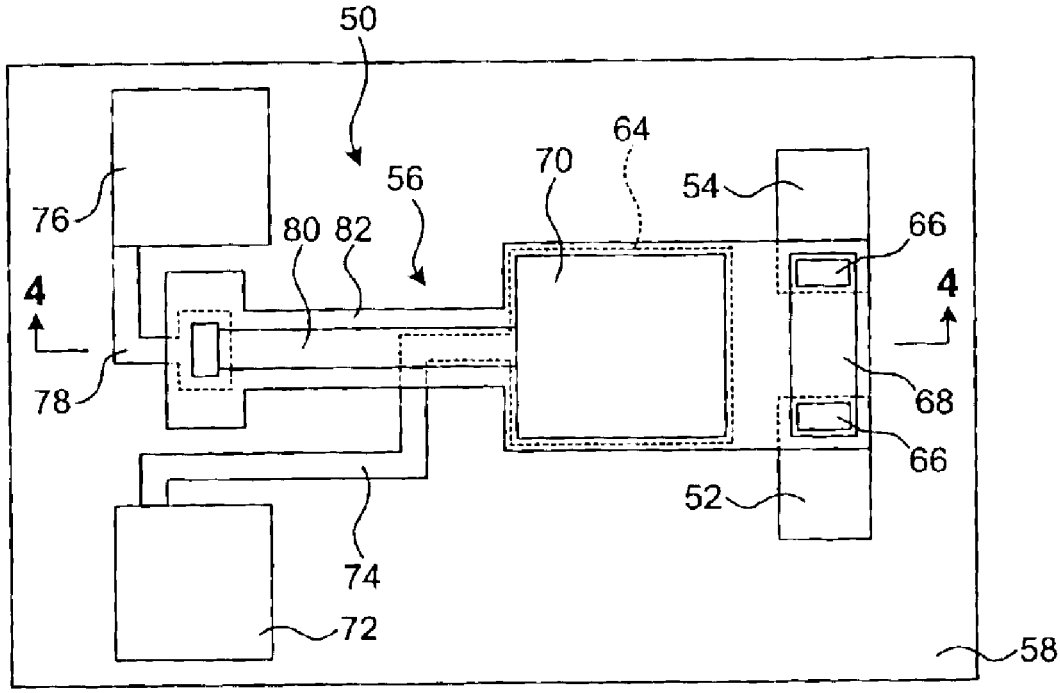
FIG. 3 is a block diagram of an exemplary MEMS switching unit for use as part of the MEMS phase shifter.

With additional reference to FIG. 3, a block diagram of an individual MEMS switching unit 50 that could be used as any of the component switching elements 38 is illustrated. Each switching unit 50 can be viewed as a single pole, single throw (SPST) switch device. More particularly, each switching unit 50 can be implemented with a MEMS series switch that interrupts signal transmission by opening a conduction path between an input transmission line 52 (e.g., a first microstrip line segment, such as a microstrip line extending between the quadrature coupler 16 and the switching element 40) and an output transmission line 54 (e.g., a second microstrip line segment, such as the transmission line stub implementing the reflecting phase shifting element 34).

Figure 4A:
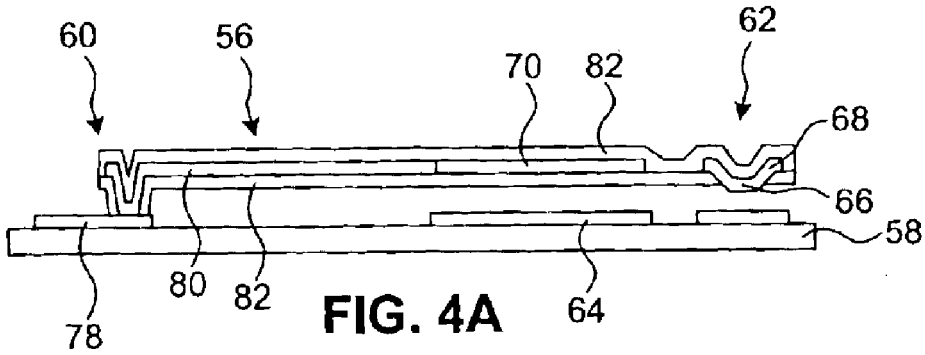
FIG. 4A is a cross section of the MEMS switching unit of FIG. 3 in an open position and taken along the line 4—4.
Figure 4B:
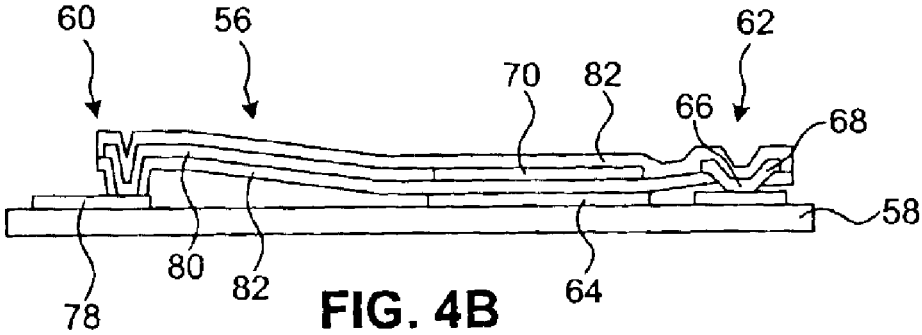
FIG. 4B is a cross section of the MEMS switching unit of FIG. 3 in a closed position and taken along the line 4—4.

Also referring to FIG. 4A (illustrating a cross-section of the switching unit 50 in an open position) and FIG. 4B (illustrating a cross-section of the switching unit 50 in a closed position), features and characteristics of the switching unit 50 will be described in greater detail. Briefly, the switching unit 50 is a contact series switch (as opposed to a capacitive coupling switch) that exhibits relatively low insertion loss and high isolation through microwave and millimeter wave frequencies. Additional details of a suitable switching unit can be found in U.S. Pat. No. 6,046,659, the disclosure of which is herein incorporated by reference in its entirety.

The switching unit 50 includes an armature 56 affixed to a substrate 58 at a proximal end 60 of the armature 56. A distal end (or contact end 62) of the armature 56 is positioned over the input transmission line 52 and the output transmission line 54. A substrate bias electrode 64 can be disposed on the substrate 58 under the armature 56 and, when the armature 56 is in the open position, the armature 56 is spaced from the substrate bias electrode 64 and the lines 52 and 54 by an air gap.

A pair of conducting dimples, or contacts 66, protrude downward from the contact end 62 of the armature 56 such that in the closed position, one contact 66 contacts the input line 52 and the other contact 66 contacts the output line 54.

The contacts 66 are electrically connected by a conducting transmission line 68 so that when the armature 56 is in the closed position, the input line 52 and the output line 54 are electrically coupled to one another by a conduction path via the contacts 66 and conducting line 68. Signals can then pass from the input line 52 to the output line 54 (or vice versa) via the switching unit 50. When the armature 56 is in the open position, the input line 52 and the output line 54 are electrically isolated from one another.

Above the substrate bias electrode 64, the armature 56 is provided with a armature bias electrode 70. The substrate bias electrode 64 is electrically coupled to a substrate bias pad 72 via a conductive line 74. The armature bias electrode 70 is electrically coupled to an armature bias pad 76 via a conductive line 78 and armature conductor 80. When a suitable voltage potential is applied between the substrate bias pad 72 and the armature bias pad 76, the armature bias electrode 70 is attracted to the substrate bias electrode 64 to actuate the switching unit 50 from the open position (FIG. 4A) to the closed position (FIG. 4B).

The armature 56 can include structural members 82 for supporting components such as the contacts 66, conducting line 68, bias electrode 70 and conductor 80. It is noted that the contacts 66 and conductor 68 can be formed from the same layer of material or from different material layers. In the illustrated embodiment, the armature bias electrode 70 is nested between structural member 82 layers.

Figure 5:
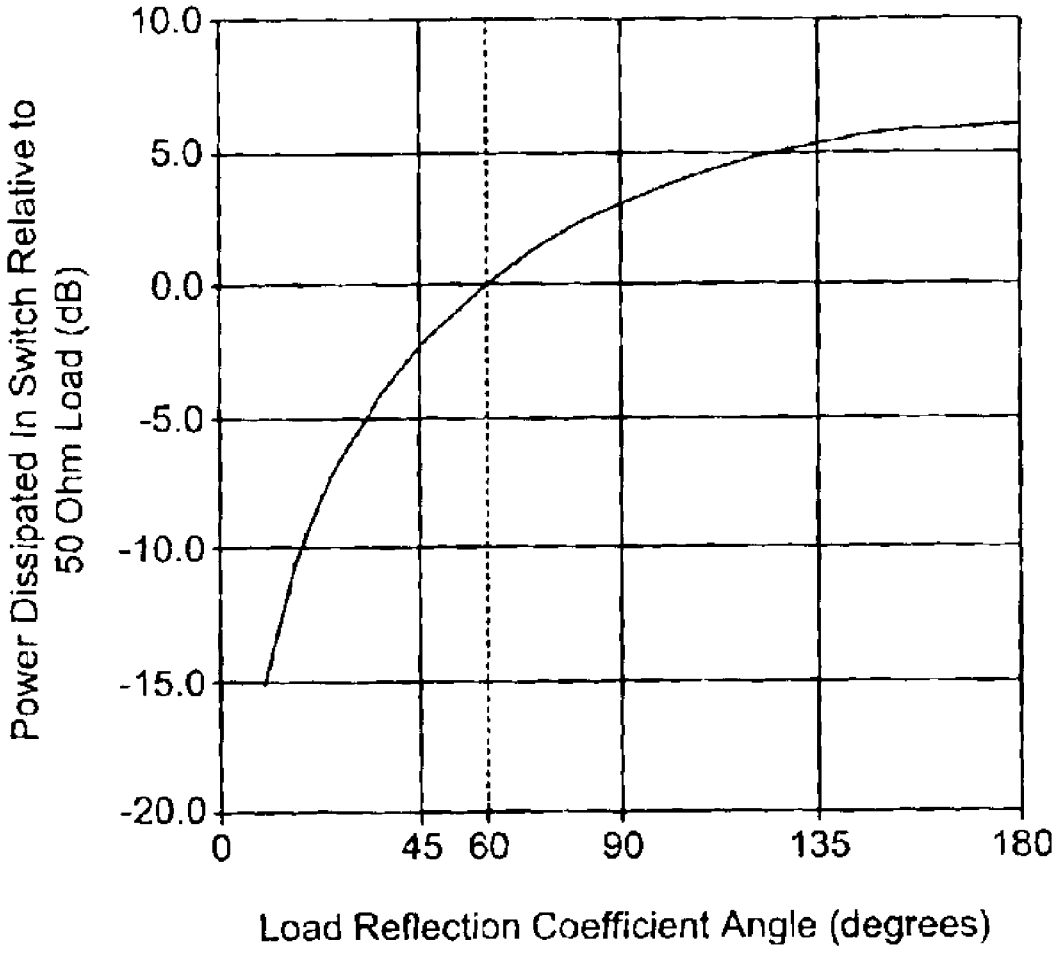
FIG. 5 is a graph of switching unit power dissipation for a MEMS switching unit used to switch a reflective load in the MEMS phase shifter relative to a MEMS switching unit used to switch a 50 ohm load in a switched path phase shifter.

Referring now to FIG. 5, a graph illustrating phase angle (X-axis) versus switching unit power dissipation for an individual MEMS switching unit 50 used as a switching element 40 for a reflecting phase shifting element 34 of a variable reactance 22, 24 relative to the same MEMS switching unit 50 used as a switching element in a switched path phase shifter as described in the background section of this document (y-axis) is shown.

At phase angles of less than approximately sixty degrees, less loss as measured by power dissipation is experienced in the switching element 40 used to switch a reflecting phase shifting element 34 than for a comparable switch used to switch a fixed delay element. Therefore, when the phase shifter 10, 26 includes reflective loads with phase shifts of less than 60 degrees each, higher input RF signals can be tolerated than when the phase shifting element is a fixed delay path.

For example, at a phase shift of 45 degrees, the phase shifter 10, 26 results in about a 5.5 dB improvement over a switched path phase shifter. A 3 dB power dissipation improvement is attributable to the power split derived from the quadrature coupler and a 2.5 dB power dissipation improvement is attributable to the switched reflective phase shift load design using a MEMS switching unit 50 and a transmission line stub as the reflecting phase shifting element 34. As the graph indicates, the lower the phase angle shift of the load, the greater the power dissipation improvement. At 22.5 degrees of phase shift, the improvement over a switch path phase shifter is about 8.5 dB.

As should be appreciated, a phase shifter 10, 26 with an appropriate number of stages 28 where each stage 28 has variable reactances 22, 24 with one or more reflecting phase shifting loads 34 of relatively small phase angle(s) (e.g., 45 degrees, 30 degrees, 22.5 degrees, 12.25 degrees, 10 degrees, etc.) can be constructed to increase the power handling capability of the phase shifter 10, 26 and/or to attain a desired phase shift resolution. However, the illustrated phase shifter 26 employing plus and minus 45 degree phase shifters and plus or minus 22.5 degree phase shifters can adequately be used in most applications where a four bit phase shifter (sixteen phase angle increments) is desired. In addition, using the illustrated combination of four pairs of switched 45 degree reflecting loads 34 to achieve a phase shift of 180 degrees can result in an 8.5 dB power dissipation improvement over a conventional short circuit used to achieve a 180 degree phase shift.

The power handling improvement in the switched reflective load arrangement illustrated and described herein results from passing a relatively small amount of RF current through the switching elements 40. In particular, the power is split by the quadrature coupler before the RF input signal is incident on the switching elements 40. Also, the current through the contacts (e.g., the contacts 66) of the switching elements 40, where the greatest loss within the switching element 40 occurs, is kept low due to the relatively high impedance (e.g., greater than 50 ohms) of the transmission line stubs used to implement the reflecting phase shifting loads 34.

For a transmission line stub capable of introducing a sixty degree phase shift, the current through the associated switching element 40 is about the same as the current through the switches of a conventional switched path phase shifter and the current will continue to increase with greater phase shift angle. At sixty degrees and higher, the greater current amounts result in greater power dissipation in the switching element 40 relative to the power dissipation of a MEMS switch used in a conventional switched path phase shifter. As a result, to enhance power handling capability using reflecting phase shifting elements 34, each reflecting phase shifting element 34 should be kept to a phase shift angle of, in one embodiment, between plus sixty degrees and minus sixty degrees to realize a power handling improvement over a conventional switched path phase shifter (it is noted that a 3 dB power handling improvement can still be attained at any angle due to the power split introduced by the quadrature coupler 16). In another embodiment, each reflecting phase shifting element 34 is kept to a phase shift angle of about plus 45 degrees or less to about minus 45 degrees or higher (e.g., the phase angle is about plus 45 degrees to about minus 45 degrees) to provide relatively high impedances, low RF currents through the switching elements 40 and an improved power handling design.

The embodiment where each phase shifting element 34 ranges from about plus 45 degrees to about minus 45 degrees provides particularly favorable results in terms of optimizing RF power handling and phase shifter 10, 26 circuit layout. Although increased power handling can be attained using loads that introduce phase angles that are smaller than plus or minus 45 degrees, more reflecting phase shifting elements 34 and MEMS switching elements 40 (and perhaps quadrature couplers 16) may be needed to construct the phase shifter 10, 26. As a result, the size and geometric complexity of the phase shifter 10, 26 will have a corresponding increase. It is noted that circuit layout size and geometry issues can be a concern in RF circuits, especially where the proximity of various components to one another is a consideration as is found in many antenna applications.

It is also noted that the overall configuration of the phase shifter(s) 10, 26 described herein as seen by the RF signal traversing the phase shifter 10, 26 can be implemented as a 50 ohm system. However, the individual phase shifting elements 34 where phase shifts occur, employ higher impedances.

When the switching elements 40 arc implemented with MEMS devices (e.g., the MEMS switching unit 50), each switching element 40 exhibits a relatively low insertion loss and high isolation through microwave and millimeter wave frequencies. For example, the insertion loss of the MEMS switching element 40 is generally between about −0.10 dB to about −0.16 dB over the frequency range of about 0.0 GHz to about 40 GHz. Therefore, the use of MEMS switching elements 40 are preferred over conventional RF switching devices implemented with, for example, PIN diodes and gallium arsenide (GaAs) field effect transistors (FETs).

Although particular embodiments of the invention have been described in detail, it is understood that the invention is not limited correspondingly in scope, but includes all changes, modifications and equivalents coming within the spirit and terms of the claims appended hereto.

What is claimed is:

1. A phase shifter for shifting the phase of a radio frequency (RF) signal, comprising:

a quadrature coupler having an input port, an output port, a first load port and a second load port;

a first variable reactance having a first plurality of reflecting phase shifting elements each having an associated micro electro mechanical system (MEMS) switching element to individually and selectively couple the reflecting phase shifting elements of the first variable reactance to the first load port; and a second variable reactance having a second plurality of reflecting phase shifting elements each having an associated MEMS switching element to individually and selectively couple the reflecting phase shifting elements of the second variable reactance to the second load port.

2. The phase shifter according to claim 1, wherein:

the quadrature coupler splits an RF input signal received at the input port such that a first portion of the RF power associated with the RF input signal is output at the first load port and a second portion of the RF power is output at the second load port;

the first variable reactance phase shifts the first portion and returns the phase shifted first portion to the first load port;

the second variable reactance phase shifts the second portion and returns the phase shifted second portion to the second port; and the quadrature coupler combines the first and second phase shifted portions and outputs the combined signal at the output port.

3. The phase shifter according to claim 1, wherein each reflecting phase shifting element is a transmission line stub.

4. The phase shifter according to claim 1, wherein each MEMS switching element is a MEMS series switch that interrupts signal transmission by opening a conduction path between a microstrip line extending from the quadrature coupler to the MEMS switching element and the reflecting phase shifting element.

5. The phase shifter according to claim 1, wherein the quadrature coupler is implemented with microstrip lines.

6. The phase shifter according to claim 1, wherein the quadrature coupler and the variable reactances are formed as part of a monolithic circuit.

7. The phase shifter according to claim 1, wherein the quadrature coupler is implemented as a Lange coupler.

8. The phase shifter according to claim 1, wherein each reflecting phase shifting element is configured to introduce a fixed phase shift angle from the range of about plus 45 degrees to about minus 45 degrees.

9. A phase shifter for shifting the phase of a radio frequency (RF) signal, comprising:

a first and a second phase shifter stage each including:

a quadrature coupler having an input port, an output port, a first load port and a second load port;

a first variable reactance having a first plurality of reflecting phase shifting elements each having an associated micro electro-mechanical system (MEMS) switching element to individually and selectively couple the reflecting phase shifting elements of the first variable reactance to the first load port; and a second variable reactance having a second plurality of reflecting phase shifting elements each having an associated MEMS switching element to individually and selectively couple the reflecting phase shifting elements of the second variable reactance to the second load port; and wherein the output port of the first phase shifter stage is coupled to the input port of the second phase shifter stage.

10. The phase shifter according to claim 9, wherein each phase shifter stage introduces a phase shift on an RF signal as follows:

the quadrature coupler splits an RF input signal received at the input port such that a first portion of the RF power associated with the RF input signal is output at the first load port and a second portion of the RF power is output at the second load port;

the first variable reactance phase shifts the first portion and returns the phase shifted first portion to the first load port;

the second variable reactance phase shifts the second portion and returns the phase shifted second portion to the second port; and the quadrature coupler combines the first and second phase shifted portions and outputs the combined signal at the output port.

11. The phase shifter according to claim 9, wherein each reflecting phase shifting element is a transmission line stub.

12. The phase shifter according to claim 9, wherein each quadrature coupler and each variable reactance are formed as part of a monolithic circuit.

13. The phase shifter according to claim 9, wherein each quadrature coupler is implemented as a Lange coupler.

14. The phase shifter according to claim 9, wherein each reflecting phase shifting element is configured to introduce a fixed phase shift angle from the range of about plus 45 degrees to about minus 45 degrees.

15. The phase shifter according to claim 9, wherein the phase shifter has a total of sixteen reflecting phase shifting elements and associated MEMS switches arranged in a four bit configuration.

16. The phase shifter according to claim 9, wherein the phase shifter has a phase increment resolutions of 22.5 degrees.

17. The phase shifter according to claim 9, wherein the variable reactances of the first phase shifter stage each include a pair of positive angle phase shifting elements of the same phase shift amount and a pair of negative angle phase shifting elements of the phase shift amount.

18. The phase shifter according to claim 17, wherein the variable reactances of the second phase shifter stage each include a phase shifting element having phase shift angle less than the phase shift amount of the phase shifting elements of the first phase shifter stage.

19. The phase shifter according to claim 9, wherein the variable reactances of the first phase shifter stage each include a pair of plus 45 degree loads and a pair of minus 45 degree loads and wherein the variable reactances of the second phase shifter stage each include a pair of plus 45 degree loads, a minus 45 degree load and a minus 22.5 degree load.

20. The phase shifter according to claim 1, wherein each variable reactance includes at least one inductive phase shifting element for introducing a positive phase shift and at least one capacitive phase shifting element for introducing a negative phase shift.

21. The phase shifter according to claim 20, wherein the inductive and capacitive phase shifting elements are transmission line stubs.

22. The phase shifter according to claim 9, wherein each variable reactance includes at least one inductive phase shifting element for introducing a positive phase shift and at least one capacitive phase shifting element for introducing a negative phase shift.

23. The phase shifter according to claim 22, wherein the inductive and capacitive phase shifting elements are transmission line stubs.

* * * * *